United States Patent [19]

Grunewald

[11] 4,038,103

[45] July 26, 1977

[54] DISHWASHER FILTER FLUSHING SYSTEM

[75] Inventor: Ernst Grunewald, Troy, Ohio

[73] Assignee: Hobart Corporation, Troy, Ohio

[21] Appl. No.: 709,169

[22] Filed: July 27, 1976

[51] Int. Cl.[2] ..... B08B 3/02

[52] U.S. Cl. ..... 134/10; 134/25 A; 134/104; 134/111; 134/176; 134/186

[58] Field of Search ..... 134/10, 25 A, 104, 111, 134/176, 186

[56] References Cited

U.S. PATENT DOCUMENTS

| | | | |
|---|---|---|---|
| 3,090,391 | 5/1963 | Kaldenberg et al. | 134/104 |
| 3,129,711 | 4/1964 | Schmitt-Matzen | 134/104 X |
| 3,323,529 | 6/1967 | Geiger et al. | 134/104 |
| 3,491,780 | 1/1970 | Kaldenberg | 134/104 |
| 3,575,185 | 4/1971 | Barbulesco | 134/104 |
| 3,709,236 | 1/1973 | Field et al. | 134/104 |

*Primary Examiner*—S. Leon Bashore
*Assistant Examiner*—Richard V. Fisher

[57] ABSTRACT

Dishwasher pumping and filtering system provides for recirculation of filtered liquid in the form of either washing solution or rinse water, coupled with outside water-jet impingement flushing of filtered food particles from the filtering system and down a drain at the end of a washing or rinsing period while draining the liquid from the dishwasher.

10 Claims, 8 Drawing Figures

DISHWASHER FILTER FLUSHING SYSTEM

BACKGROUND OF THE INVENTION

This invention is an improvement in the type of dishwasher shown in U.S. Pat. No. 3,323,529 issued to Geiger et. al. In that patent, there is disclosed a system for pumping filtered fluid through a wash arm by means of a recirculating pump while the sump of the dishwasher is being drained, so that descending wash solution or rinse water directs food particles and other debris toward the drain until the sump is almost completely drained. To accomplish this result, the flushing action relied both on falling water from the upwardly directed spray issuing from the wash arm and on the normal turbulence of draining water. While the flushing system of the Geiger patent was a considerable improvement over then-existing systems, the design and shape of the filtering screen, plus the tenacity of certain types of food particles to cling to the underside of the screen disclosed in that patent made complete flushing difficult, and required occasional screen removal from the machine for cleaning, depending on the soiled condition of dishes normally placed in the washer by the operator.

Providing a recirculating pump with a filtering system around the pump intake, and providing additional means for utilizing a portion of the filtered fluid to flush debris from the filtering system, is known from U.S. Pat. No. 2,552,493 issued to Newton, U.S. Pat. No. 3,090,391 and 3,491,780 granted to Kaldenberg, and U.S. Pat. No. 3,575,185 granted to Barbulesco. In a typical such dishwashing machine the fluid is filtered and recirculated under pressure to spray the dishes for removing the food soil. The filtering is by a fine mesh screen, and it is especially desirable that the mesh of the screen be very fine, so that recirculated liquid which contacts the dishes will contain less and less soil as washing and subsequent rinsing progress. This presents a problem, however, in that the finer the screen, the quicker the tendency toward clogging and starvation of the recirculating pump. This is due to the reduced ability of the screen to pass sufficient water as it becomes increasingly clogged and impervious, depending of course on the amount and type of food soil on the dishes. The approach of the aforementioned prior art patents was to provide a high velocity stream of water internally of the screen to break loose any food soil which might be clinging to the outside of the screen. A portion of the filtered water was therefore directed upstream, backwardly through the fine screen to dislodge debris and food particles clinging thereto. Of course, the stream had to have sufficient pressure to overcome the negative pressure within the screen caused by suction at the pump inlet, and it was hoped the loosened soil would descend to the bottom of the sump and into the drain section for draining at the completion of that particular portion of the machine cycle.

However, the turbulence of water in the sump and the nature of the food particles in suspension in the water do not always permit such particles to lie in a quiescent state at the sump bottom. On the contrary, smaller particles are likely to stay in suspension and be repeatedly drawn into contact with the outer surface of the fine screen and again backflushed away from the screen, because of the nature of the structure providing the backflushing. This constant working, both as a result of the repetitive jet pressure of the backflow and of the mechanical action caused by the repeated intermittent contact of food particles with the screen, tends to disintegrate the particles, reducing their sizes so that many may become small enough to pass through the screen openings and be recirculated. The undesirable result of such a breakdown in the size of the particulate matter is the increased possibility of continuous redeposition thereof onto the dishes throughout the remainder of the dishwashing and rinsing cycles. This would considerably increase the likelihood of leaving minute food particles on the dishes at completion of the total cycle, thus requiring additional rinsing and the attendant excessive use of water to overcome this problem.

A further purpose of the so-called self-cleaning filtering systems of the aforementioned prior art, i.e., in addition to attempting to keep the screen sufficiently clean to enable passage of water therethrough, is to flush food soil off the screen and down the drain at the completion of each washing or rinsing period. This reduces the frequency of removing the fine screen from the dishwasher for hand cleaning.

In addition, the Kaldenberg and Barbelusco patents show either a submerged rotating jet mechanism or a submerged rotating screen to accomplish the desired backflushing action. Because they are submerged, they can be expected to require somewhat more driving force than would be necessary if the flushing elements were above the water level. For the most part, such prior art machines also require auxiliary devices to provide the cleaning action on the screen, rather than making use of equipment which is already present in most dishwashers of this type.

SUMMARY OF THE INVENTION

The present invention provides a pumping and filtering system for a domestic or household type dishwasher which includes a fine-mesh filtering screen for cleaning food particles and other debris from liquid which is recirculated by the pump to wash the dishes. The screen is concentric with the vertical axis of rotation of a conventional rotatable wash arm, and the wash arm is provided with at least one downwardly-directed water jet opening on the underside of the wash arm to flush or hose the screen while fluid is being drained from the dishwasher at the end of each of the several washing or rinsing periods which constitute a complete washing cycle. A drain pump and the recirculating pump are operated simultaneously during draining. The inlet to the recirculating pump is through the fine-mesh screen, and the inlet to the drain pump is through a coarse filter. Both inlets are at or near the bottom of the sump so that both pumps continue to pump fluid, the wash arm continues to rotate, and hence the jet of flushing water exiting from the water jet opening remains active to flush the screen, until the sump is almost completely drained. Additionally, as the water drains, the water jet tends to break up larger food particles which may have been softened during washing, to enable their passage through the course filter and into the sewage system to which the drain is connected.

It is therefore an object of the present invention to provide a method and apparatus for flushing the fine mesh screen of a recirculating dishwashing machine; a method and apparatus which functions effectively to help flush filtered debris from the screen down the drain during the drain portions of the dishwashing cycle, but which does not appreciably mechanically work the debris against the fine mesh screen during the recirculating portions of the wash and rinse periods prior to draining; which uses the components already present in such a dishwasher, requiring essentially no parts in addition thereto; which provides a jet opening on the underside of an already present wash arm to direct a stream of water under pressure against the outer surface of the fine mesh screen at an angle to flush debris downwardly therefrom; and to accomplish the above objects and purposes in an economical, uncomplicated and durable configuration providing extended service life and durability.

Other objects and advantages of the invention will be apparent from the following description, the accompanying drawings and the appended claims.

DESCRIPTION OF THE PREFERRED EMBODIMENT

Figure 1:
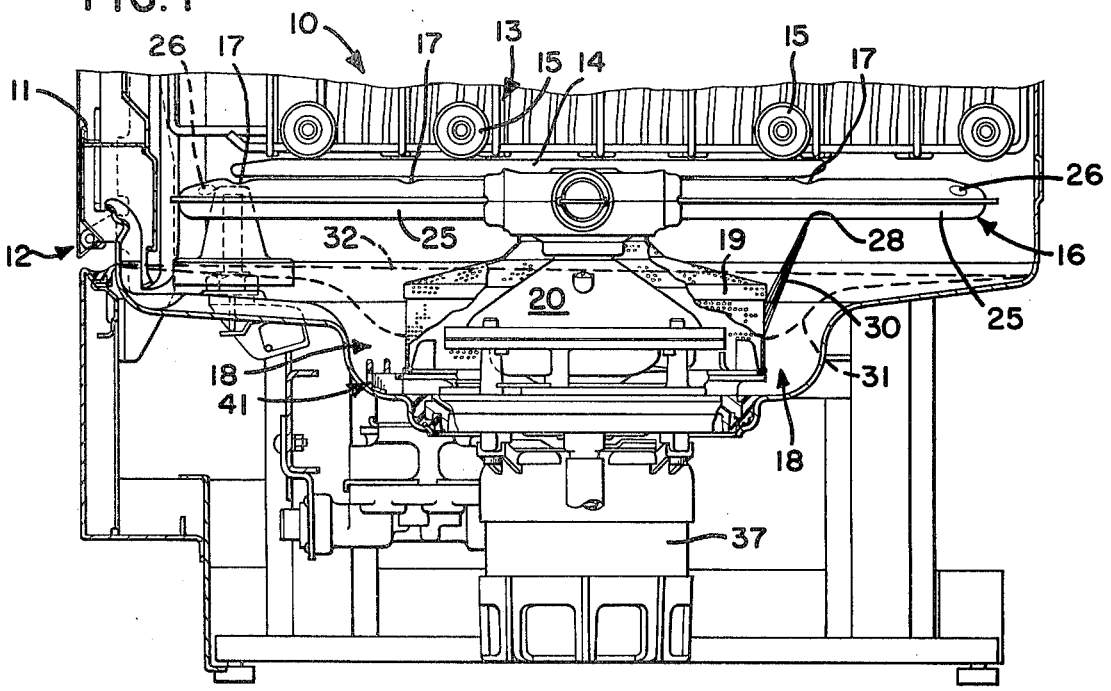
FIG. 1 is a side elevational, cross-sectional view of the lower portion of a domestic dishwasher embodying the invention.
Figure 2:
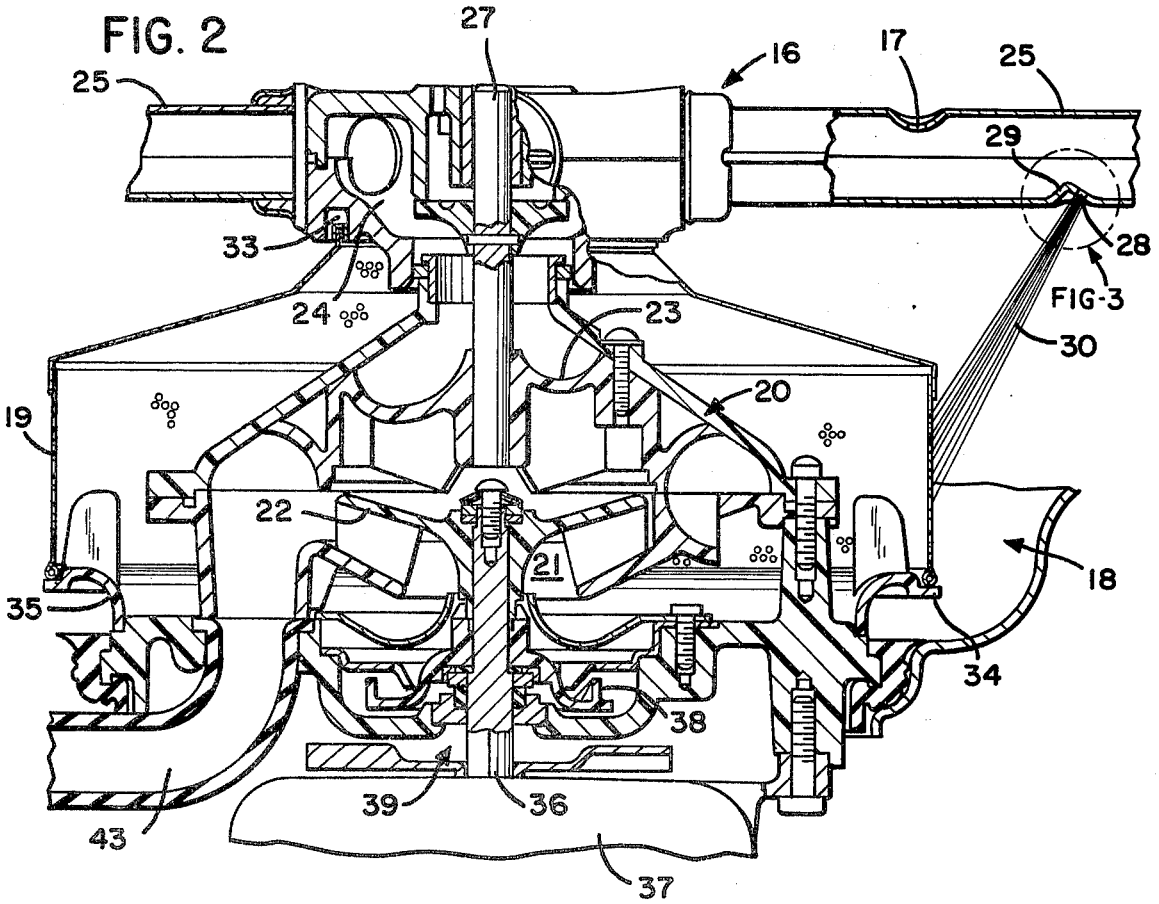
FIG. 2 is an enlarged view of a portion of a pumping and filtering system utilizing the invention, illustrating selected details of the internal construction of the pump and wash arm.

A dishwasher embodying the invention includes an enclosed housing or wash chamber 10 which is provided with a door 11 on one side, hinged at 12 to pivot downwardly to expose the interior of the chamber 10. Typically, a dishwasher of this type contains upper and lower dish and utensil-supporting racks 13, only the lower one of which is illustrated in FIG. 1. These racks are generally horizontally movable in and out of the chamber 10 on tracks 14 and rollers 15 to expose the racks outwardly of the chamber for loading of dishes and other articles to be washed. After loading, they are returned inwardly to the position shown and are arranged to be sprayed by water jets issuing from a wash arm 16 which is provided with conventional water jet openings 17 such as illustrated in FIG. 2. The spray then descends toward a sump 18 at the bottom of the chamber 10, is filtered by a fine mesh screen 19, and enters a recirculating FIG. 2 as being approximately at the same level of the bottom of the sump 18. A pump impeller 22 directs water under pressure upwardly through the pump 20 and into the wash arm 16 in much the same fashion as is discussed in aforementioned U.S. Pat. No. 3,323,529.

Since the details of construction of the pump and the mounting of the wash arm are not necessary for a complete understanding of this invention, those structures will not be described in detail, but can be readily understood from a viewing of FIG. 2. The path of water from the impeller 22 upwardly to the wash arm 16 follows a spiral path, exiting through an opening (not shown) at the side of a member 23 remote from the viewer. In addition, water may be pumped to an upper wash arm and/or rinse arm (not shown) through a conduit 43. Liquid passing through the top of the pump 20 passes into a chamber 24 formed by a hub which mounts a plurality of tubes 25 which make up the wash arm 16. One or more tubes are provided at their extremities with angularly directed propelling or thrust jets 26. The jets 26 act in unison not only to assist in washing dishes thereabove, but also to provide rotation of the wash arm 16 about a stationary shaft 27 which is carried by the upper portion of the pump 20. The sizing of the jets 26 and 17 is to provide the most efficient speed of rotation of the wash arm 16 and velocity of upwardly-directed water issuing from jets 17, to optimize the washing action on the dishes contained within the racks 13.

Figure 3:
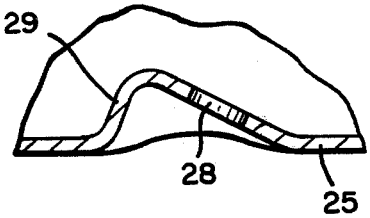
FIG. 3 is an enlarged view of the water jet opening included within the dot-dash circle designated FIG. 3 at the upper right side of FIG. 2.
Figure 4:
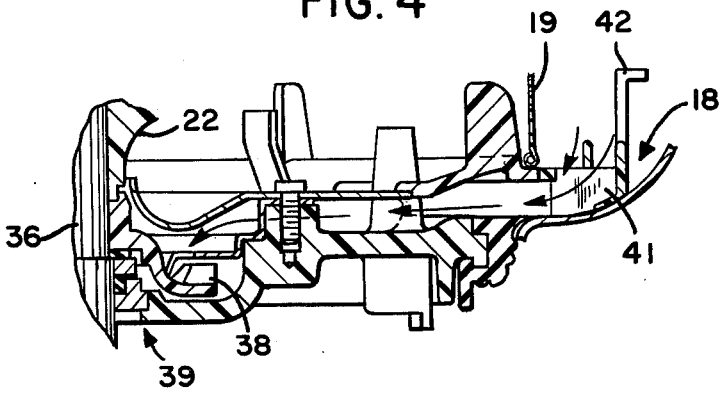
FIGS. 4 and 5 are enlarged cross-sectional views of a selected portion of a draining system which may be utilized with the invention.

In addition to the jets 26 and 17, one or more water jet openings 28 are located on the underside of the tubes 25. A single jet opening has been found quite suitable, the opening being approximately 0.090 inches in diameter. FIG. 3 is an enlarged view of a jet opening 28 formed by an inward dimpling which is stamped in a hollow tubes 25, providing an inwardly protruding portion in the hollow space of the wash arm. The dimpling is formed with a steep wall 29 on the side thereof nearest the hub of the wash arm 16. The purpose of this is to provide turbulence of the water as it flows over and past the jet opening 28, to minimize any tendency of minute solids which may have found their way into the wash arm 16 from clogging the opening 28. The side of the dimple remote from the hub of the wash arm 16 is preferably sloped essentially perpendicular to the desired direction of a high velocity jet 30 to be produced by liquid leaving the opening 28. The liquid jet 30 is arranged to impinge on the fine mesh screen 19 at generally the upper portion thereof to provide an effective top-to-bottom flushing action of the cylindrical vertical wall of the screen as the wash arm 16 rotates under the influence of water issuing from the jets 26. Each underside jet opening 28 is of smaller size than the upwardly-directed jet opening 26 and 17 in the wash arm to maintain sufficient velocity and active flushing action of the stream of water 30 impinging on the screen 19 during draining.

Figure 5:
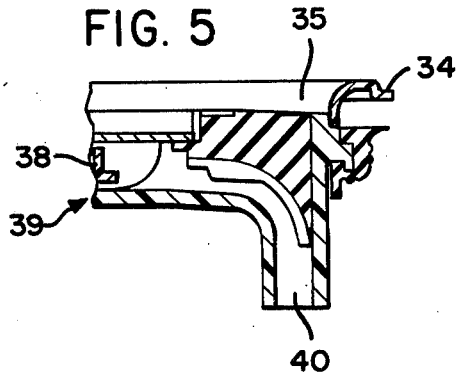
Figure 6:
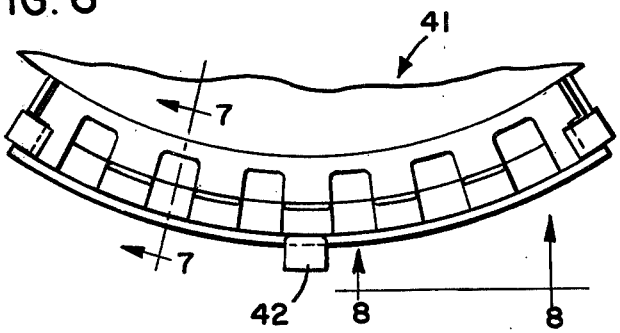
FIG. 6 is an enlarged plan view of a coarse filter for preventing large food and waste particles from entering the draining system of FIG. 4; and, FIGS. 7 and 8 illustrate cross-sectional details taken along lines 7—7 and 8—8 respectively, of FIG. 6.
Figure 7:
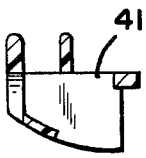
Figure 8:
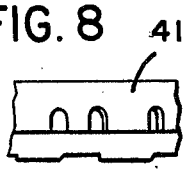

Dishwashers are designed to take into consideration both the varying dynamic and static water levels in the sump. The dynamic level normally fluctuates somewhat during machine operation but is approximately illustrated in FIG. 1 by the dotted lines 31. The dotted lines 32 show the static fill level, i.e., the level when the pumps are not operating. The static level is made to coincide with the perforated conical section of the fine mesh screen 19. This section merges at its upper portion, as shown in FIG. 2, into an annular groove 33 in the hub of the wash arm 16. The lower, cylindrical portion of the screen 19 rests on a flange 34 of an annular support member 35 which is mounted concentrically with respect to the shaft 27 and a shaft 36 of a motor 37. Shaft 36 mounts both the pump impeller 22 and an impeller 38 of a drain pump section 39. Pump section 39 is illustrated in FIGS. 2 and 5, the latter Figure being angularly located with respect to FIG. 2.

OPERATION

Assuming that heavily soiled dishes are to be washed, such as at the start of a complete washing cycle, water issuing from the jets 17 and contacting the soiled dishes will remove some loose soil therefrom, which will fall by gravity to the sump 18. There the soiled liquid will be strained by the fine mesh screen 19 and recirculated through the wash arm 16 by means of the pump impeller 22. Water will also issue from jet 28 toward the fine mesh screen 19.

The jet of water 30 from jet opening 28 has been located to act only on the outer surface of the cylindrical portion of the screen 19, as distinguished from the repeated action of high velocity water jets constantly trying to remove food soil from inside the screen 19 during the entire wash cycle such as is described in the aforementioned prior art. And, instead of being directed in opposition to water which is flowing through the screen toward the pump, i.e., upstream of water flow, the jet 30 provides a downwardly-directed glancing action so as to flush food particles clinging to the screen downwardly toward the drain pump section 39. In so doing, the particles first pass through a coarse filter 41 which is provided to capture large food particles, toothpicks, or the like.

As noted earlier, the dynamic water level 31 will fluctuate vertically depending on several things, including the amount of food soil present in the liquid. For example, if the level 31 at screen 19 is at the height shown in FIG. 1, the jet 30 (or jets, if more than one is utilized) will act primarily on the upper half of the cylindrical portion of the screen 19, since penetration of the jet into the water flowing through the screen will be negligible. Thus, although liquid is constantly flowing through the jet opening 28 toward the screen during each wash or rinse period, it normally has negligible affect at these times on food soil clinging to the screen. This minimizes redeposition problems which might result from continual reduction of particle size. However, if the liquid is extremely heavily soiled, so as to clog most of the lower half of the screen, the dynamic level 31 will rise somewhat. Since this level will then be nearer the water jet opening 28, the force of the jet 30 will tend to penetrate to a greater depth and maintain the area of the screen immediately below the dynamic water level cleansed. This type of action will be similar to that discussed previously in connection with those prior art patents teaching the use of water pressure from inside the screen. Theoretically, the dynamic water level may be permitted to approach nearly to the static water level 32, since the screen 19 is preferably perforated throughout its height, although such is not essential for practical use of the invention. Soil conditions are seldom so bad, however, that they will cause clogging more than one-half to two-thirds upwardly from the bottom of the cylindrical portion of the screen.

The primary function of the jet 30 is to provide a final flushing action of the cylindrical portion of the screen 19 as liquid is being drained from the sump 18. At the actual time of draining, motor 37 is operating and driving the drain pump 39, the drain 40 having now been opened by conventional valve means (not shown). The motor simultaneously drives the pump impeller 22 to force liquid through the wash arm 16. So long as the water level is at or above the "eye" of inlet portion 21 of the pump 20, water under pressure will continue to issue from openings 17 to spray the dishes, jets 26 will continue to rotate the wash arm 16, and jet opening 28 will continue to orbit around and thus flush down the outer cylindrical wall of the screen 19. Since the inlet 21 is located adjacent the very bottom of the sump 18, this flushing action by the jet of water 30 continues until practically all water has been drained. In addition, as the water level drops near the level at which the coarse filter 41 rests, the jet 30 striking the cylindrical wall of the screen 19 glances with some pressure remaining to break up any softened large food particles which have come to rest on the coarse filter 41. Water going to the drain 40 follows the arrows illustrated in FIG. 4 through the coarse filter 41, then toward the impeller 38, and then outwardly of the drain pump section 39 through the drain 40. The openings in the coarse filter and the arrangements of passages therethrough are therefore designed to permit particles to pass if they are of a size sufficient to be handled effectively by a typical sewer connection to which the drain 40 is connected. As shown in FIGS. 4, 6, 7, and 8, the coarse filter is readily removable by grasping a tab 42 and lifting it upwardly from a seat near the bottom of the sump to remove debris which is too large to pass through. Since the coarse filter itself forms no part of this invention except that it is located in a position to be partially acted upon by the jet 30 during draining, its detailed description is unnecessary.

The simplicity of the provision of the jet opening 28 on the underside of one or more of the tubes 25 of the wash arm 16, the reduction of "working" of food soil clinging to the fine screen during normal recirculation, and the utilization of the jet 30 for flushing until the water level in the sump has dropped to the bottom thereof, are all advantageous improvements in a dishwasher of this type. The jet 28, while shown as a hole in a tube 25, can be provided in other forms of nozzles, although the chances of clogging may be increased by so doing.

While I prefer that the motor 37 be unidirectional, and that the pump and drain impellers be designed for most efficient operation when driven in the same direction of rotation, it is considered within the scope of my invention to provide a reverse direction of rotation of the pump impeller while draining the sump, provided sufficient water can be passed through the wash arm and a jet on its underside to perform as previously described. Furthermore, to the extent that the essence of the invention might be practiced by separate arms for upward and downward spraying, such is considered an obvious equivalent, although inherently more complex and expensive.

While the method herein described, and the form of apparatus for carrying this method into effect, constitute preferred embodiments of this invention, it is to be understood that the invention is not limited to this precise method and form of apparatus, and that changes may be made in either without departing from the scope of the invention.

What is claimed is:

1. In a washing machine having a closable wash chamber, a sump at the bottom thereof, a recirculating pump having an outlet, and having an inlet in the sump for recirculating water from the sump into the chamber, a drain at the bottom of the sump, a horizontal hollow wash arm located above the normal static level of wash water in the sump and mounted for rotation on a vertical axis, the wash arm being in fluid communication with the output of the recirculating pump and having a plurality of upwardly directed water jet openings for spraying articles thereabove, means for rotating the wash arm about said vertical axis when fluid is being sprayed therefrom, and an article supporting open-structure rack supported in the chamber above but closely adjacent to the wash arm, the improvement comprising:

a generally vertically extending fine mesh filtering screen covering the inlet of the recirculating pump, said screen being mounted to separate the drain from the recirculating pump inlet, and means forming at least one water jet opening on the underside of the wash arm and arranged to direct a stream of water under pressure downwardly from the wash arm against the outer surface of said screen at an angle so as to flush food particles clinging to the outer surface thereof in a downward direction toward the sump bottom so long as the recirculating pump is operating and the level of water in the sump is at or above its inlet.

2. A washing machine according to claim 1 further comprising a drain pump having an inlet connected to the drain, wherein both said recirculating and drain pumps are operated simultaneously, and wherein the orbital movement of said underside jet is located to direct flushed particles from the outer surface of said screen toward the bottom of the sump to the drain pump inlet as the water level descends during draining.

3. A washing machine according to claim 2, wherein the recirculating pump inlet is approximately at the horizontal level of the bottom of the sump to maintain the flushing action until substantially all water is drained from the sump.

4. A washing machine according to claim 1, further comprising a coarse filter extending adjacent at least a portion of the bottom of said screen for trapping food particles larger than normally acceptable for passage through a sewage system, said coarse filter separating the inlet to said drain pump from the wash chamber to require all water to pass through said coarse filter during draining, said coarse filter being located with respect to the direction of said stream of water impinging on the side of said fine screen so that softened, large food particles trapped by said coarse filter may be contacted by said water stream and thus reduced in size to pass through said coarse filter for subsequent draining through the sewage system.

5. A washing machine according to claim 1, further comprising an inwardly protruding portion in the hollow space of the wash arm, and wherein said underside jet opening is formed as a hole through said inwardly protruding portion, the end of said hole at the inner side of the wash arm being on the side of said protruding portion remote from the axis of rotation of the wash arm.

6. A washing machine according to claim 5, wherein the wash arm is constructed of hollow tubing and wherein said protruding portion is an inwardly directed dimple stamped in said tubing.

7. A washing machine according to claim 1, wherein said underside jet opening is of smaller size than the upwardly-directed jet openings in the wash arm, to maintain sufficient velocity and active flushing action of said stream of water impinging on said screen during draining.

8. A washing machine according to claim 1, wherein said fine mesh screen extends upwardly a substantial distance above the sump bottom and further comprises a perforate conical section extending inwardly and upwardly toward the axis of rotation of the wash arm.

9. In a washing machine having a closable wash chamber, a sump at the bottom thereof, a pump having an inlet for recirculating water from the sump into the chamber, a drain pump operated simulutaneously with the recirculating pump and having an inlet at the bottom of the sump, a horizontal freely rotatable hollow wash arm constructed of hollow tubing and located above a normal static level of wash water in the sump and mounted for rotation on a vertical axis, the wash arm being in fluid communication with the output of the recirculating pump and having a plurality of upwardly-directed water jet openings for spraying dishes thereabove and at least one laterally directed opening for imparting rotary thrust to the wash arm, and a dish-supporting open-structure rack supported in the chamber above, but closely adjacent to, the wash arm, the improvement comprising:

a. a non-rotatable vertically-positioned generally cylindrical fine-mesh filtering screen surrounding the inlet of the recirculating pump and mounted concentrically with the axis of rotation of the wash arm, the top of said screen having a perforate conical section extending inwardly and upwardly toward the axis of rotation of the wash arm, and said screen having its bottom edge closely adjacent the sump bottom and mounted to separate the drain pump inlet from the recirculating pump inlet, which latter inlet is located approximately at or below the bottom edge of said screen, b. means forming at least one water jet opening on the underside of the wash arm and located a distance from said axis greater than the radius of said screen, said last-named opening being arranged to direct a stream of water under pressure downwardly from the wash arm against the outer surface of said screen at an angle so as to flush food particles clinging to the outer surface thereof in a downward direction so long as the recirculating pump is operating and the level of water in the sump is at or above its inlet, the orbital movement of said underside jet being located to direct flushed particles from the outer surface of said screen toward the bottom of the sump to the drain pump inlet as the water level descends during draining, said underside jet opening being of smaller size than the upwardly and laterally-directed jet openings in the wash arm, to maintain sufficient velocity and active flushing action of said stream of water impinging on said screen while the wash arm is spraying and rotating as a result of water pressure therein from the recirculating pump, c. means locating the inlet to the recirculating pump at approximately the horizontal level of the bottom of the sump to maintain the flushing action until substantially all water is drained from the sump, d. a coarse filter extending arcuately adjacent at least a portion of the bottom of said screen for trapping food particles larger than normally acceptable for passage through a sewage system, said coarse filter separating the inlet to the drain pump from the wash chamber to require water to pass through said coarse filter during draining, said coarse filter being located with respect to the direction of said stream of water impinging on the side of said fine screen so that softened, large food particles trapped by said coarse filter may be contacted by said water stream and thus reduced in size to pass through said coarse filter for subsequent draining through the sewage system, and e. an inwardly protruding dimple portion stamped in the hollow space of the wash arm, said underside jet opening being formed as a hole through said inwardly protruding dimple portion, the end of said hole at the inner side of the wash arm being on the side of said protruding portion remote from the axis of rotation of the wash arm.

10. In a washing machine including a sump at the bottom of a wash chamber and a drain in the sump, a method of flushing food particles from the wash chamber and its contents while draining, including the steps of:

introducing washing liquid into the sump, converting the washing liquid in the sump into spray form by means of a recirculating pump, having an inlet in the sump for recirculating liquid from the sump into the chamber, and a spraying device to clean the food particles from items contained in the wash chamber, filtering food particles from the liquid prior to its reentering the inlet of the recirculating pump by means of a screen having a vertical axis and a substantially vertically extending side wall and thereby trapping food particles on the side wall, and, draining the sump after completion of a desired period of liquid recirculation and maintaining recirculation of the liquid during draining, the improvement comprising:

orbiting a downwardly-directed jet of the liquid in a circular path coincident with the screen axis and spraying the jet against the exterior of the screen with sufficient velocity and at an angle of incidence with respect thereto to flush trapped food particles downwardly toward the bottom of the sump for draining from the washing machine.

* * * * *

UNITED STATES PATENT AND TRADEMARK OFFICE

CERTIFICATE OF CORRECTION

PATENT NO. : 4,038,103

DATED : July 26, 1977

INVENTOR(S) : Ernst Grunewald

It is certified that error appears in the above-identified patent and that said Letters Patent are hereby corrected as shown below:

Col. 3, line 54, after "recirculating" insert -- pump 20 at a lower inlet portion 21, which is viewed in --.

Col. 3, line 54, delete "same".

Col. 4, line 21, delete "tubes" and insert -- tube --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*